US006516644B1

(12) United States Patent
Seliber

(10) Patent No.: US 6,516,644 B1
(45) Date of Patent: Feb. 11, 2003

(54) METHOD OF MASTER KEYING A SYSTEM OF LOCKS

(75) Inventor: Lloyd Seliber, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 09/361,071

(22) Filed: Jul. 26, 1999

(51) Int. Cl.[7] ..... E05B 35/10
(52) U.S. Cl. ..... 70/340; 70/342
(58) Field of Search ..... 70/340–343, 337–339

(56) References Cited

U.S. PATENT DOCUMENTS 1,100,266 A * 6/1914 Sparks ..... 70/341
1,122,816 A * 12/1914 Teich ..... 70/341
1,135,027 A * 4/1915 Kohlberger ..... 70/341
1,440,459 A * 1/1923 Greff ..... 70/342
1,590,232 A * 6/1926 Fremon ..... 70/341
5,000,019 A * 3/1991 Foster ..... 70/341 X

* cited by examiner

*Primary Examiner*—Lloyd A. Gall
(74) *Attorney, Agent, or Firm*—Michael Best & Friedrich LLP

(57) ABSTRACT

A method of assigning change keys and master keys in a master key system using a 6 pin cylinder with 5 bittings based on an 8×8 checkerboard and pieces ¼, 1, 4, 16 squares in size representing 16, 64, 256 and 1024 change keys with a master key bitting combination available for each piece which would operate all the change keys assigned to that piece. A first alternate embodiment uses an array of $(b-1)^{(p-3)}$ elements (b being the number of bittings and p being the number pins used for master keying), each array element representing $(b-1)^3$ change keys. The array being repeatedly divided into subarrays of $(b-1)^{(p-x)}$ elements, where x=4, 5, 6, . . . , p−1. Instead of assigning the change keys to a checkerboard piece, the change keys are assigned to a subarray representing at least the number of change keys.

15 Claims, 9 Drawing Sheets

METHOD OF MASTER KEYING A SYSTEM OF LOCKS

BACKGROUND OF THE INVENTION

This invention relates generally to master key systems and more particularly to a method of assigning change keys and master keys for a master key system.

One of the most common requests seen on orders for new master key systems is to "provide for maximum expansion". The customer makes this request to extend the life of the newly purchased master key system. Unfortunately the term "maximum expansion" is completely meaningless. The expansion potential of a key system is defined by the mechanical characteristics of the cylinder. There is no way to configure a system to exceed those characteristics, and there are several ways to allocate the expansion inherent in them. No single expansion configuration is optimal for every facility and none of them will accommodate every possible future event.

The most effective strategy to prevent the early replacement of a key system is to:

Plan it using prudent budgeting techniques.

Implement it using effective project management.

Protect it with sound key control practices.

A system that is not correctly planned and budgeted is doomed to failure from the start. While this first step is essential, it is often shortchanged because the people in the best position to contribute have the least understanding of cylinder mechanics and the mathematics of master keying. To facilitate good planning in the key system design phase, a tool is needed which would allow those people to participate in the process effectively.

Planning tools are paradigms that allow users to understand keying issues without having to understand locks. One such tool is the popular "dividing the key" paradigm. An example of the use of this tool would be to say that in a six pin grand master key system you were using "two pins for masters and four pins for changes." That would yield (in a traditional Schlage lock style system) 16 masters of 256 changes each. The same expansion could have been allocated differently using, for example, "three pins for masters and three pins for changes" or "one pin for masters and five pins for changes." Dividing the key is a very useful tool that allows rapid analysis of user requirements. However, it paints in too broad a stroke to be used for complex systems.

The foregoing illustrates limitations known to exist in present master keying systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a method of assigning change keys and master keys in a master key system using a 6 pin cylinder with 5 bittings based on an 8×8 checkerboard and pieces ¼, 1, 4, 16 squares in size representing 16, 64, 256 and 1024 change keys with a master key bitting combination available for each piece which would operate all the change keys assigned to that piece. A first alternate embodiment uses an array of $(b-1)^{(p-3)}$ elements (b being the number of bittings and p being the number pins used for master keying), each array element representing $(b-1)^3$ change keys. The array being repeatedly divided into subarrays of $(b-1)^{(p-x)}$ elements, where x=4, 5, 6, . . . , p−1. Instead of assigning the change keys to a checkerboard piece, the change keys are assigned to a subarray representing at least the number of change keys.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

The following are definitions of a few common master keying terms:

Master key system is any keying arrangement that has two or more levels of keying.

Change key is a key that operates only one cylinder or one group of keyed alike cylinders in a keying system.

Bitting is the number(s) which represent the dimensions of the key cut(s) on a key.

Levels of keying are the divisions of a master key system into hierarchies of access. Level 1 is the lowest level and consists only of change keys. The highest level is the top master key that operates all locks in the master key system.

MACS is maximum adjacent cut specification, or the maximum allowable difference between adjacent cut depths.

Cross keying is the deliberate process of combinating a cylinder (usually is a master key system) to two or more different keys which would not normally be expected to operate it together.

Master key is a key which operates all the master keyed locks or cylinders in a group, each lock or cylinder usually being operated by its own change key.

Grand master key is a key which operates two or more separate groups of locks, which are each operated by a different master key.

A key system schematic is used to illustrate levels of keying, a drawing with blocks utilizing keying symbols, usually illustrating the hierarchy of all keys within a master key system. It indicates the structure and total expansion of the system.

Figure 1A:
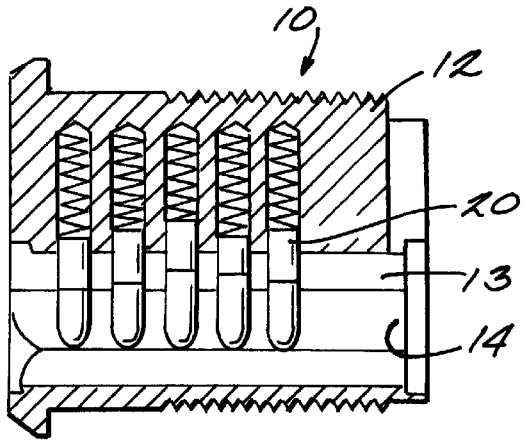
FIGS. 1A through 1C show a typical pin tumbler cylinder.
Figure 1B:
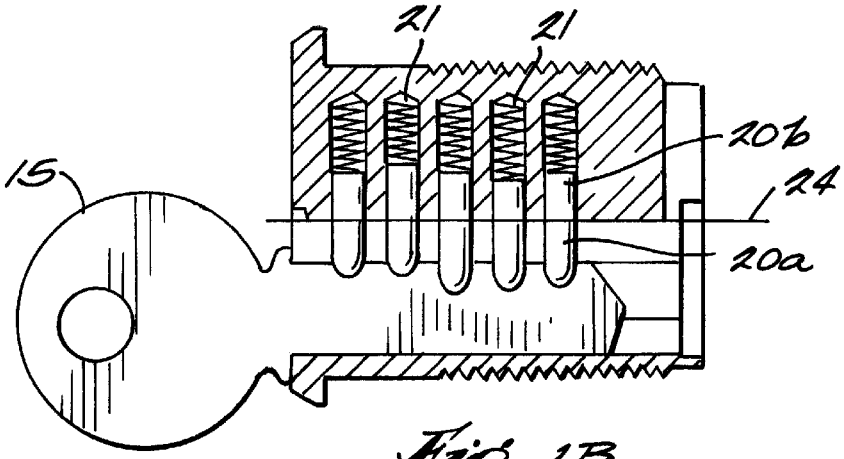
Figure 1C:
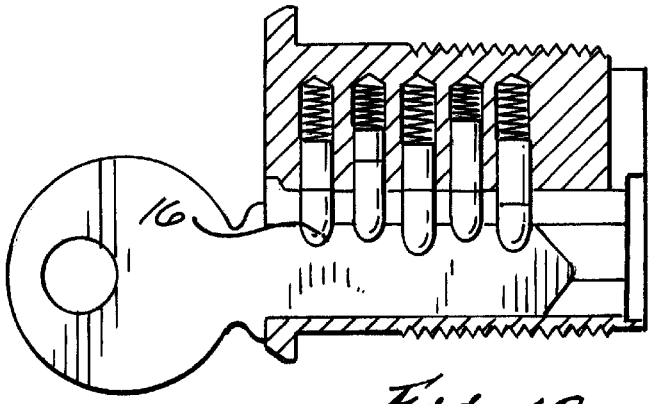

FIGS. 1A through 1C show a typical pin tumbler cylinder 10. The cylinder 10 consists of a shell 12 having a rotatable plug 13 within. The plug 13 has an axially extending keyway 14, which accepts key 15. A series of cuts 16 are placed on the upper edge of key 15. Within the shell 12 and plug 13 are a plurality of pins 20 and springs 21. Pins 20 are comprised of at least two segments, a bottom pin 20*a* and a top pin or driver 20*b*. When a cylinder has been pinned for master keying, one or more master pins 20*c* (see FIGS. 1D and 1E) are used in each pin stack. The depths of the cuts 16 on the key 15 are called bittings and typical are numbered from 0 to 9. With no key 15 inserted in the cylinder 10, the top pins 20*b* and bottom pins 20*a* are forced by the springs 21 down into the plug 13. The top pins 20*b* are then partially in the shell 12 and partially in the plug 13, forming an obstacle that keep the plug 13 from turning, as shown in FIG. 1A. When a proper key 15 is inserted into the cylinder 10, the bitting depth of the cuts 16 brings the top of each of the bottom pins 20*a* exactly to the surface of the plug 13, forming a shear line 24, as shown in FIG. 1B. With the tops of the bottom pins 20*a* aligned with the shear line 24, the key 15 and the plug 13 can be turned. When an incorrect key 15 is inserted, one or more of the top and bottom pins 20*b*, 20*a* will not align with the shell 12 surface to form the shear line 24, thereby preventing rotation of the key 15 and plug 13, as shown in FIG. 1C.

Figure 1E:
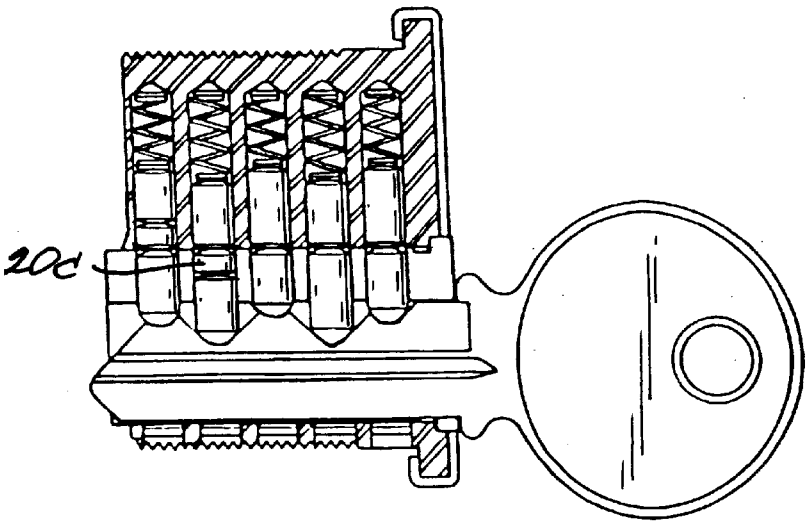
FIGS. 1D and 1E show a typical master keyed pin tumbler cylinder.
Figure 1D:
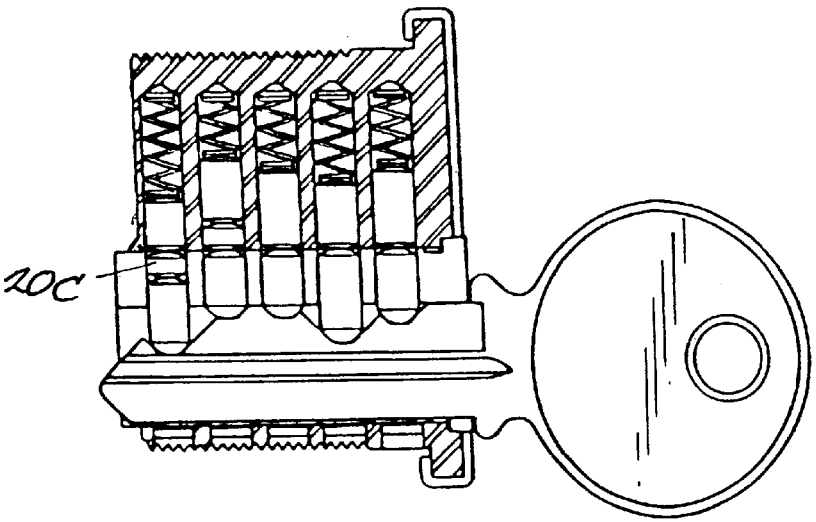

FIGS. 1D and 1E illustrate a typical cylinder 10 which has been pinned for master keying. The term "master keyed" usually denotes that each individual cylinder is operated by two or more different keys. The key that normally opens only one cylinder or keyed alike group of cylinders is called a change key. The key that opens all the cylinders in a group or series is called a master key. An example of a simple master key system would be in a small office building. There would be an individual change key for each office door, and there would be a master key to operate all office doors. The essential difference between an ordinary pin tumbler cylinder and a master keyed cylinder is the use of master pins 20*c*. A master pin is an additional top pin, usually shorter, which is inserted between the bottom pin 20*a* and the top pin 20*b*. In each pin chamber where a master pin 20*c* is located, a second shear position is created. The cylinder can be operated at either shear position. Thus, different key bittings can be used for each position where there is a master pin. FIG. 1D shows a master keyed cylinder 10 with a change key 15 inserted and FIG. 1E shows the same master keyed cylinder 10 with a master key 15 inserted. In both FIGURES, the pins 20 have aligned to form a shear line 24, thereby permitting the key 15 and plug 13 to rotate.

Figure 2:
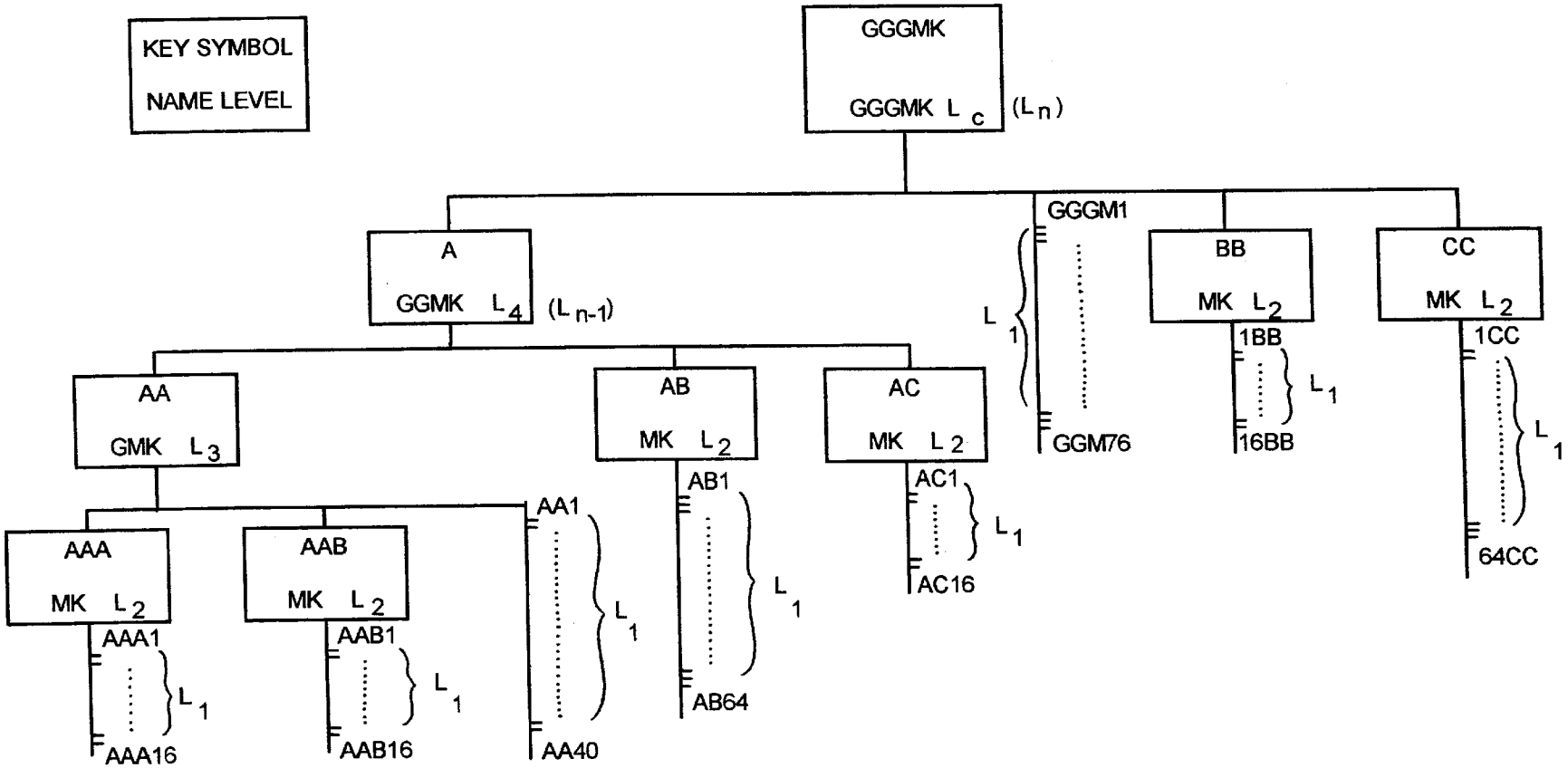
FIG. 2 shows a sample key system schematic.

FIG. 2 shows a key system schematic for a five level system of change keys and master keys. The levels are numbered from 1 ($L_1$), the lowest level and which is assigned to the change keys, to the highest level n ($L_5$ in FIG. 2) which consists of the master key which will operate all the locks in the system. The first level below level $L_n$ is assigned a key symbol of A, B, . . . , Z. (However, if the master key below level $L_n$ has no master keys below it, key symbols of AA, BB, . . . , ZZ are used.) The next level below is AA, AB, . . . , AZ for master keys below A and AAA, AAB, . . . , AAZ for master keys below AA. Change keys are always level $L_1$ and have a key symbol the same as the master key with which they are grouped followed by a number. In FIG. 2, there are 16 change keys grouped under master key AAA having key symbols, AAA1, AAA2, . . . , AAA16. The first level above the change keys are named Master Keys (MK). The highest level master key is named based upon the number of levels in key system schematic, even if it is also a first level master key above a group of change keys. In the example shown in FIG. 2, a five level system, the top level ($L_5$) master key is named Great Great Grand Master Key (GGGMK). Intermediate level master keys are named according to the number of levels below them. Master Keys AAA and AAB are Level $L_2$. Master key AA, level $L_3$, is named Grand Master Key (GMK). Master keys AB and AC, BB, CC are named Master Keys and are level $L_2$ since they are the first master keys above change keys. Master key A is a Great Grand Master Key (GGMK) and is level $L_4$.

Figure 3:
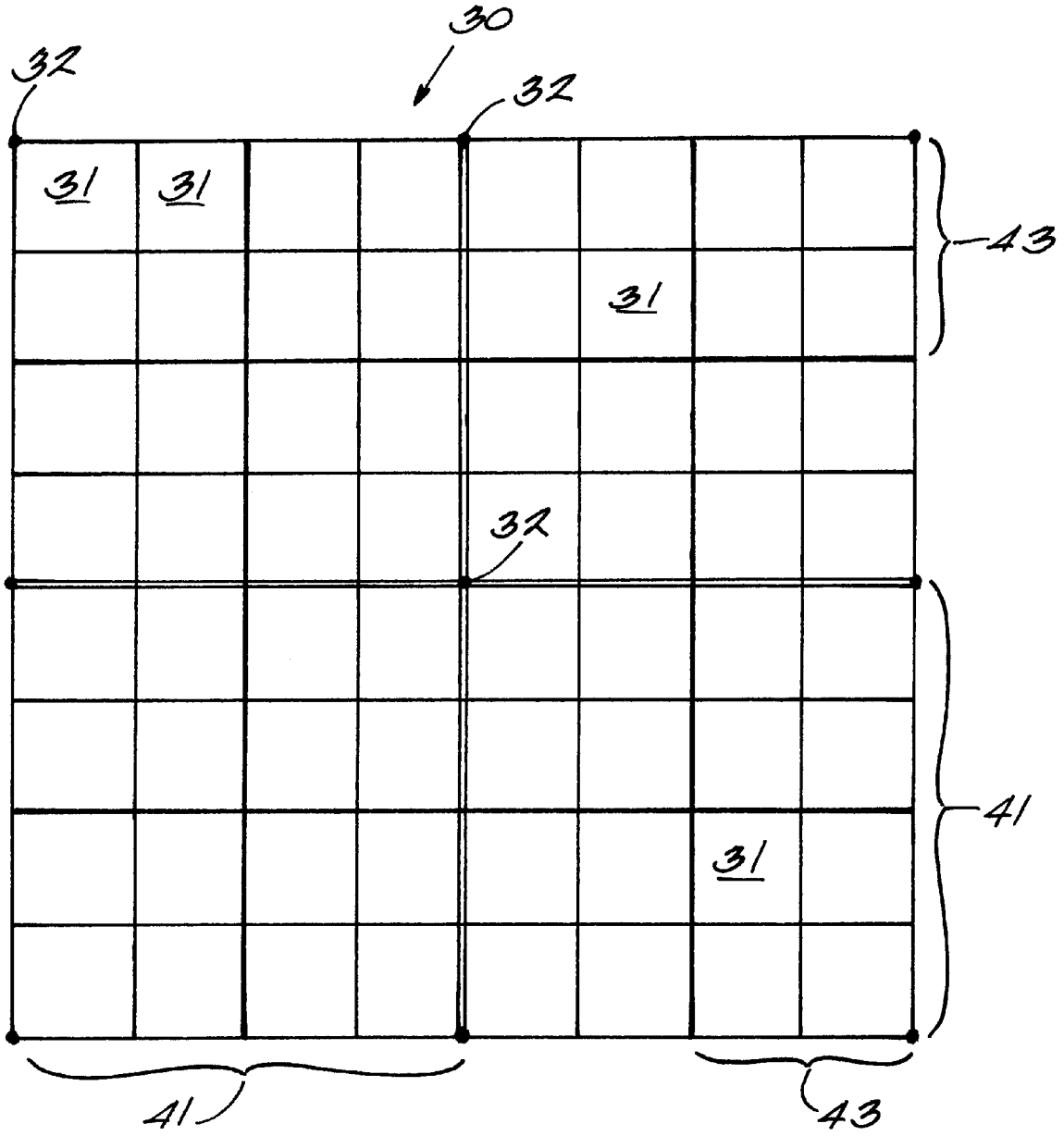
FIG. 3 illustrates a checkerboard form that can be used with the present invention.

An effective tool for planning such systems is the master key checkerboard 30 shown in FIG. 3. The checkerboard shown in FIG. 3 can be imagined as a single grand master key with 64 masters. This checkerboard is configured for a typical Schlage cylinder having 6 pins and 5 bittings with all 6 pins being used for master keying.

Figure 4:
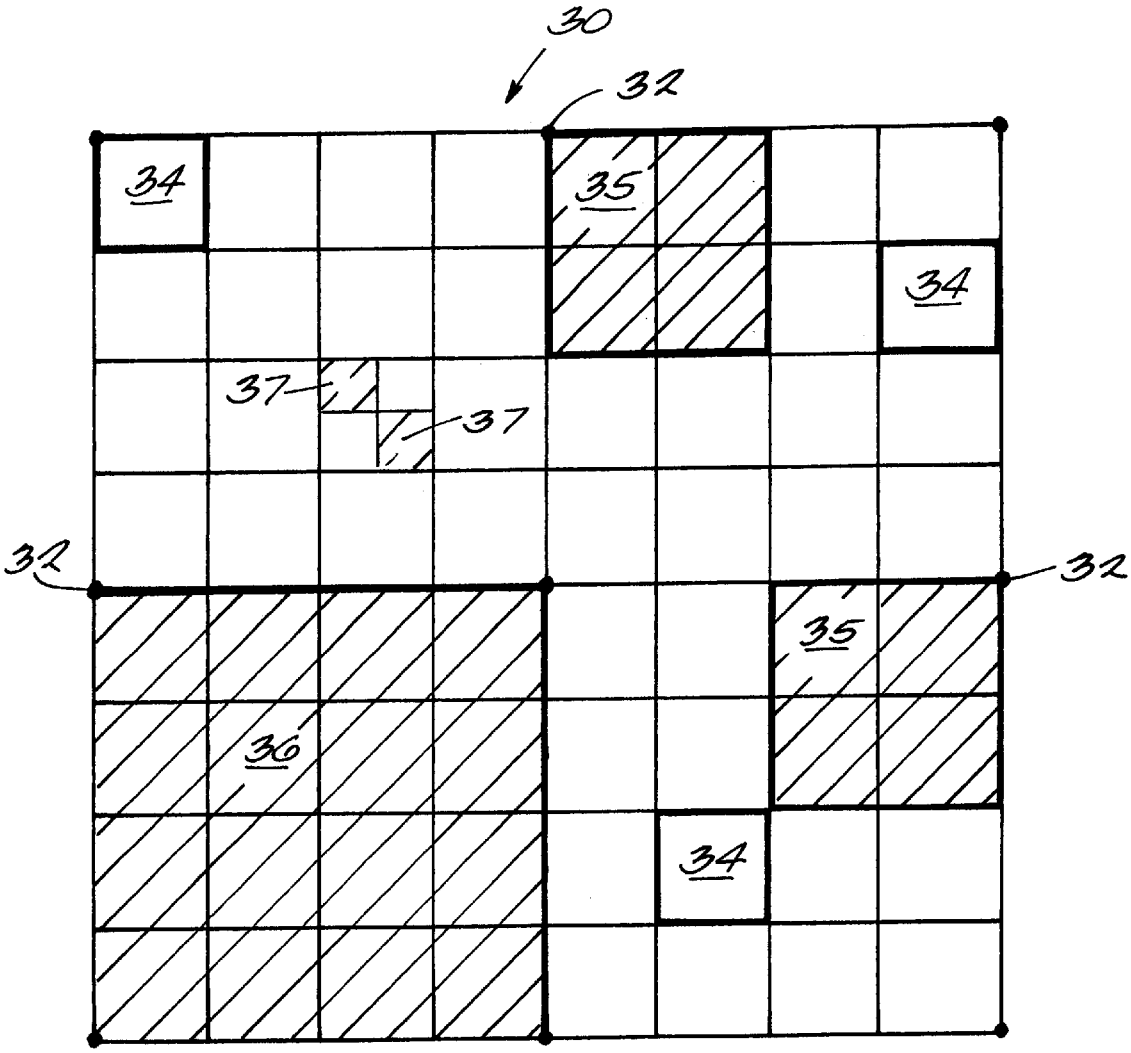
FIG. 4 shows the checkerboard of FIG. 3 illustrating the master key pieces.

Each square 31 on the checkerboard 30 is a master key of 64 changes each, i.e., 64 change keys. To use the checkerboard 30 for more detailed planning, one modifies it by adding the 9 dots 32 shown in FIG. 3. Next, you introduce the pieces to the game. The first is a single square piece 34, which is a master key with 64 changes. It can be played anywhere on the checkerboard 30. The example in FIG. 4 shows three master keys of 64 changes 34, each in play. The next piece is a master key of 256 changes 35. This is four square in size and must be played so that a corner is touching a dot 32. FIG. 4 shows two masters of 256 changes in play.

These are several types of pieces that exist on the master key checkerboard, but we need just two more to plan key systems. The first of these is the large master key of 1,024 changes 36. This master key is represented by a piece, which is 16 squares in size and, like the 256 35, must be played so that a corner touches a dot 32. FIG. 4 shows one master key of 1,024 changes 36 correctly played. The two rules that the 2×2 square master key 35 and the 4×4 master key 36 must have a corner touching one (of the dots 32 is called the "rule of the dots".

The final piece is a master key of 16 changes 37. This master is created by splitting a square 31 into quarters. Each quarter 37 becomes a master key with 16 changes each. As shown in FIG. 4, the master key of 16 changes 37 may be created on any square; the corner does not need to be touching a dot 32.

Inherent in this process is the fact that there is a master key bitting combination available for each ¼ square, 1 square, 2×2 4 square, 4×4 16 square and the entire 8×8 checkerboard. The "rule of the dots" is necessary to assure this.

Using the checkerboard paradigm, a master key system is laid out to meet the needs of a project by playing the master key pieces on the board. As the budget for each master key is set, the planners can instantly see what expansion remains. If the needs of the system exceed the capacity of a single checkerboard, you can add additional checkerboards with multiplex keyways.

One common question is "What if I want a master key with 100 changes?" The answer is that master keys do not come in sizes of 100 changes. They come in sizes of 64 and 256 but nothing in between. The size of the master keys is a property of the type of cylinders being used, one of many properties to be considered in selecting the correct cylinder platform for a key system.

Budgeting master key size is like budgeting for any other need. Look at past usage, look at future plans, consider likely scenarios, close your eyes and give it your best guess. Consider the ramifications of over budgeting. In general, over budgeting means less expansion available for other areas of the system. Over budgeting also means that if a master key is lost, a larger chunk of your expansion will be lost with it. This can significantly reduce the life of a system.

The ramifications of under budgeting are not wonderful either, but typically present problems that are easier to solve then over budgeting. The very worst thing that can happen if you under budget is having to rekey the "short" section of your system to a new master. For example if you keyed 10 locks under a master of 16 changes and later needed 10 additional changes, you would have to find a master of 64 on the chart and rekey the original 10 locks. This is less painful on small masters then large ones. Considering the risk for small a master with few keyed-alike groups will highlight why the number of locks under a master should be considered in the budgeting process. It is also good to remember that if sound key control is in force, the small master key and its changes can be reused later.

Rekeying an under budgeted section of the system will not be necessary if a trick was employed during the planning process. That trick is to plan for the elevation of a master key to the next larger size.

Figure 5:
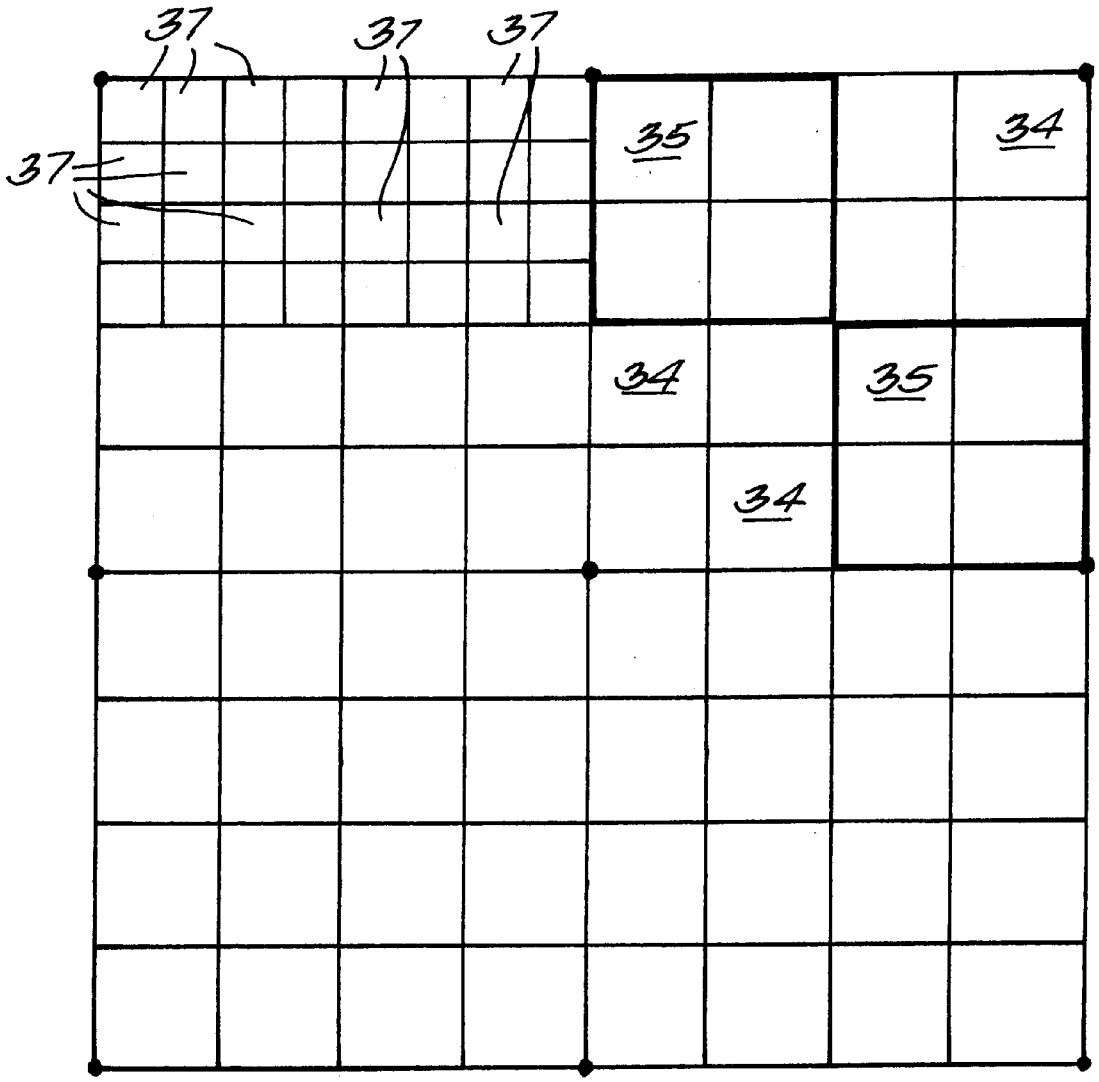
FIG. 5 shows the checkerboard of FIG. 3 illustrating a sample master key system.

Consider the system shown in FIG. 5. This system has, among other things, 11 small master keys budgeted for 16 changes each. During the key system planning meeting the most likely scenario's for 4 of the masters predicted they would not grow past 16 changes. However the other 7 were somewhat likely to need 25 or even 30 changes. Those master keys were played on the board in such a way that the master with 64 changes could later be issued without the need to rekey any locks. If the master keys are lost, or if they never need more than 16 changes, they have not been over budgeted. In the event that they need more changes, the master key that operates the whole square can be issued.

Figure 6:
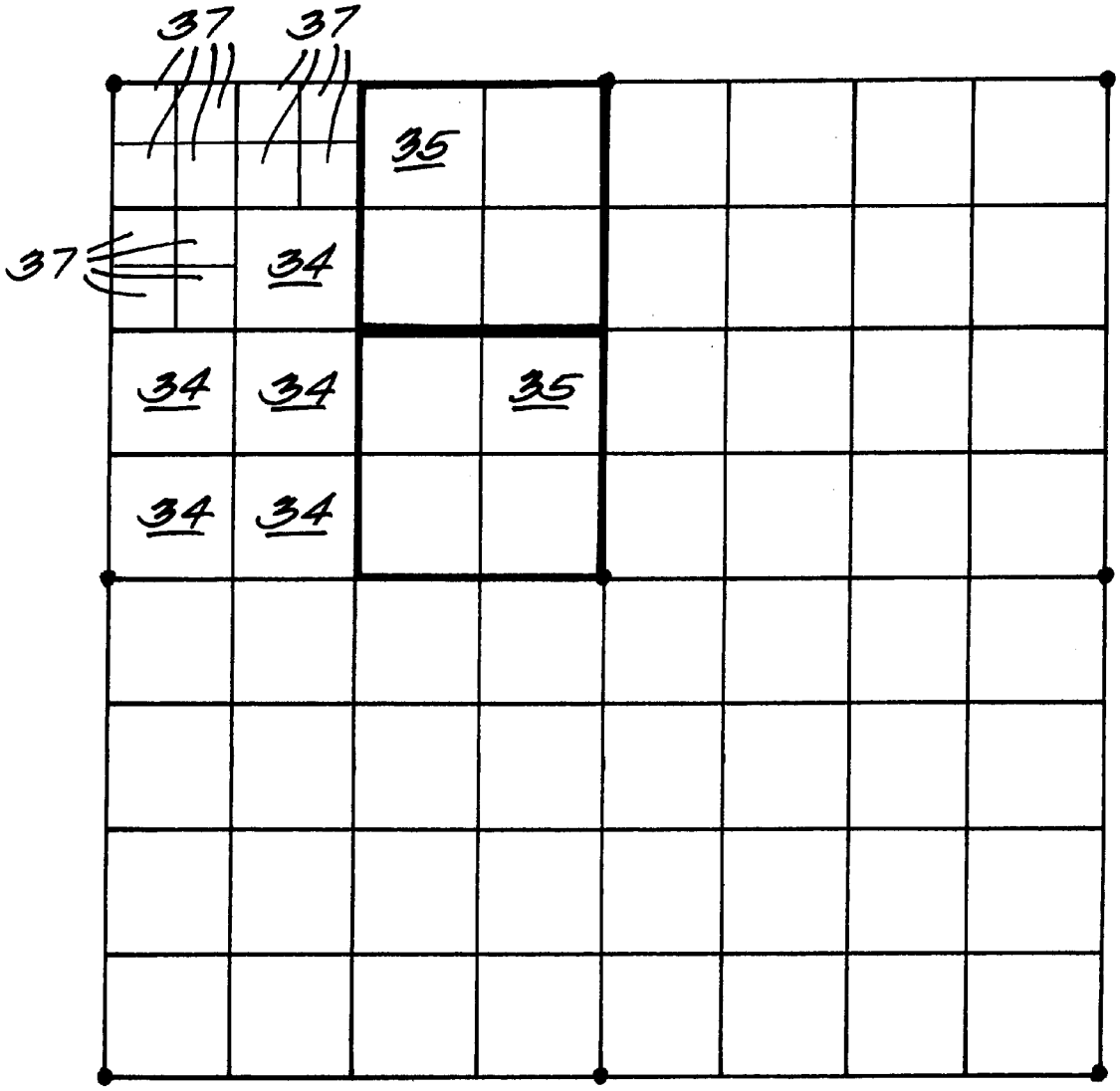
FIG. 6 shows the checkerboard of FIG. 3 illustrating a second sample master key system.

Planning for elevation is a critical part of the master key budgeting process. Compare the master key system shown in FIG. 6 with the one in FIG. 5. Both master key systems have the same number and type of master keys yet they are very different. Which one is better? The answer is neither. The systems are just different. The master key system in FIG. 6 can accommodate an expansion of 12 masters of 256 changes each, which the system in FIG. 5 can not. Each one was designed with a different need in mind.

There are two important things to point out before leaving the checkerboard. First, the checkerboard is a way to master key but it is not the only way to master key. Second is that the numbers discussed here do not account for MACS losses. Many types of cylinders use increments for adjacent key cuts that do not allow the use of all of the theoretical keys (i.e., MACS). The effect on the checkerboard 30 can be ignored at the planning stage by:

Not counting on more than 90 per cent of the capacity of a master key, for example 58 changes instead of 64 or 230 instead of 256.

Not using more than ¾ of the checkerboard.

There may be no such thing as "maximum expansion", but it is still possible to specify expansion in a way that will maximize the life of a master key system. By using the checkerboard, even a non lock-savvy end user can plan a system. Better still, the owner of the system will understand its capabilities. Along with good key control and effective project management, this will help the key system last long into the future.

Figure 7:
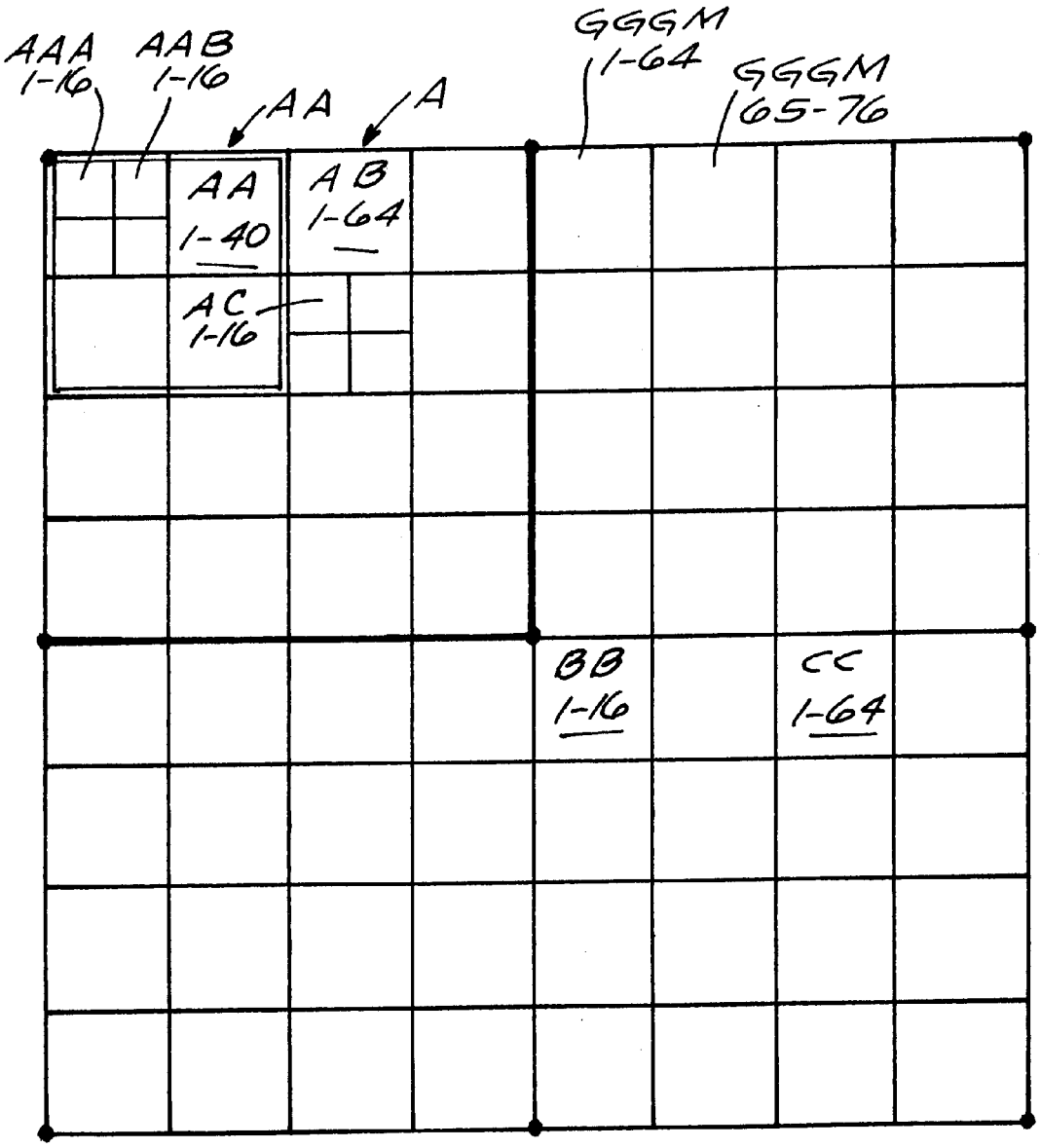
FIG. 7 shows the checkerboard of FIG. 3 illustrating the master key system shown in FIG. 2, using the method of the present invention.

To apply this master keying system to the example of the key system schematic shown in FIG. 2 (the resulting assignments are shown in FIG. 7), 1) Divide an 8×8 checkerboard into 4 4×4 checkerboards (41 in FIG. 3) and then divide the 4×4 checkerboards into 4 2×2 checkerboards (43 in FIG. 3). Note that this step is needed to enforce the "rule of the dots" described above.
2) Locate the group of unassigned change keys with the most levels of master keys above. In FIG. 2, these are change keys AAA and AAB. Select a number of unassigned contiguous squares from the checkerboard 30 and assign the selected group of change keys to the selected squares. The number of squares being ¼, 1, 4, or 16, where a 4 square selection must be one of the 2×2 checkerboards 43 and a 16 square selection must be one of the 4×4 checkerboards 41 (Note that this limitation is also needed to enforce the "rule of the dots"). All groups of assigned change keys below any master key $L_n-1-L_2$ must be within the same 2×2 checkerboard 43 or 4×4 checkerboard 41 (For the system shown in FIG. 2, all of the AAA, AAB and AA change keys must be in the same 2×2 or 4×4 checkerboard and all of the AAA, AAB, AA, AB and AC change keys must also be in the same 2×2 or 4×4 checkerboard). In addition, each 2×2 checkerboard 43 or 4×4 checkerboard 41 must only contain group assignments from a single tree (a tree being a path starting from the $L_n$ master key down to the a group of change keys). For example, in FIG. 2, change keys BB can not be in the same 2×2 or 4×4 checkerboard that contain change keys in the A tree (A, AA, AB and AC).
3) Repeating step 2 for all groups of change keys grouped below the first master key above the first selected group of change keys (in FIG. 2, this is master key AA). After assigning change keys AAA, change keys AAB must be assigned before any other change keys can be assigned.
4) Repeating steps 2 and 3 for all remaining unassigned change keys grouped below the highest master key in the tree for the selected group. In FIG. 2, the initial selected group was AAA. Therefore the remaining groups AAB, AA, AB and AC must be assigned before groups GGGM, BB and CC can be assigned.
5) Repeating steps 2 through 4 for all remaining change key groups, selecting any change key groups having only the top level master key, level $L_n$ in its respective tree. For the example shown in FIG. 2, change keys GGGM must be assigned only after all other keys have been assigned.

FIG. 7 shows a checkerboard 30 with master keying system shown in FIG. 2 assigned.

From the checkerboard 30 assignments, key bittings can be assigned to each change key and master key using typical prior art bitting progressions such as Total Position Progression, Standard Progression Format, Two Step Progression, or Single Step Progression.

The above description applies the present invention to a Schlage cylinder having 6 pins (p) and 5 bittings (b). This method can be applied to other pin and bitting combinations by using an array system. Instead of using a 8×8 checkerboard, an array of $(b-1)^{(p-3)}$ is provided. For Schlage cylinders with b=5 and p=6, this yields a 64 or 8×8 element array. The parameters are b−1 since one bitting combination is used for the master key and p−3 to limit the array size to a manageable size where each array element represents $(b-1)^3$ possible key combinations. Other offsets could be used. The array is further divided into a plurality of subarrays, the first division being into subarrays of $(b-1)^{(p-4)}$ elements, the divided subarrays being repeatedly divided into further subarrays of $(b-1)^{(p-x)}$ elements, where x=5, 6, . . . , p−1. Further, instead of assigning unassigned change keys to checkerboards, the change keys are assigned to a subarray representing at least the number of change keys. Repeatedly dividing the array into subarrays down to the smallest subarray of (b−1) elements and limiting change key assignments to one of the subarrays enforces the "rule of the dots".

Figure 8:
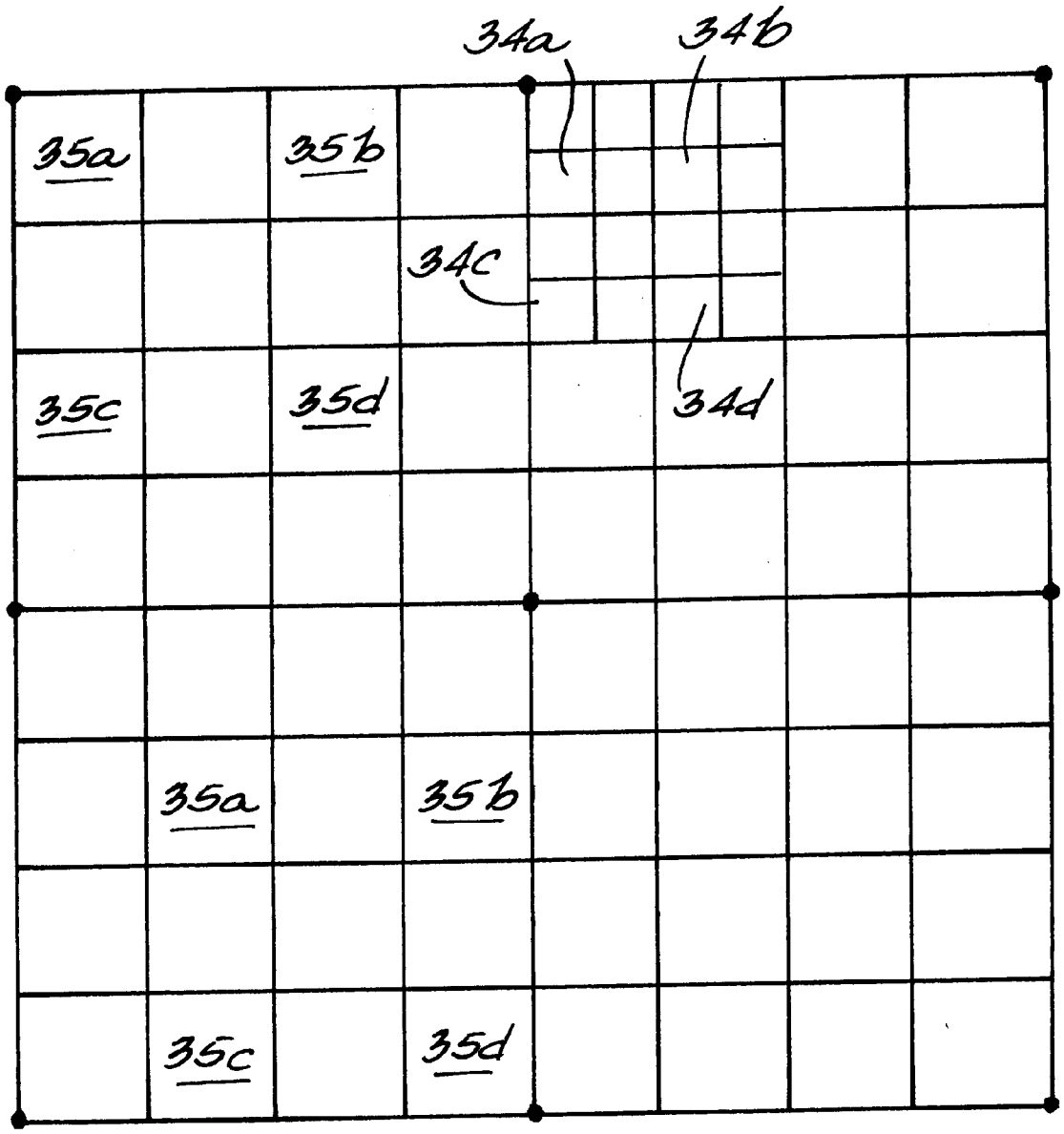
FIG. 8 shows the checkerboard of FIG. 4 illustrating an alternative method of master keying.

A second alternate embodiment of the present method is illustrated in FIG. 8, where a change key group requiring 4 squares 31 or array elements is assigned with one square in the same corner of the 4 2×2 checkerboards lying within one 4×4 checkerboard. Or selecting an initial element of the selected subarray (the subarray being at least (b−1) times the number of change keys in the group) and then selecting every $1/b-1^{th}$ element in the selected subarray. For example, in the Schlage system of 6 pins and 5 bittings, this would be the $1^{st}$, $5^{th}$, $9^{th}$, and $13^{th}$ elements or the $2^{nd}$, $6^{th}$, $10^{th}$ and $14^{th}$ elements, etc. For a system using 7 bittings, this would be the $1^{st}$, $7^{th}$, $13^{th}$, $19^{th}$, $25^{th}$ and $31^{st}$ elements in subarray of 36 elements. FIG. 8 shows two possible assignments of a master key of 256 changes, 35*a*, 35*b*, 35*c*, 35*d* and one possible assignment of a master key of 64 changes, 34*a*, 34*b*, 34*c*, 34*d*.

Having described the invention, what is claimed is:

1. Method of master keying a system of locks, the locks using a 6 pin cylinder, each pin having 5 bittings, the method comprising:

a) providing a key system schematic, the key system schematic defining: 1) a plurality of levels of master keys, the lowest level master key being level $L_2$ and the highest level master key being $L_n$, 2) a plurality of change keys, the change keys being assigned to a master key and assigned to groups, 3) a plurality of trees consisting of a master key and any lower level master keys and change keys which are operated by the master key;

b) providing an 8×8 checkerboard array having 64 squares wherein each square represents 64 possible key bitting combinations, the checkerboard being divided into subarrangements of 4 4×4 checkerboards and the 4×4 checkerboards being divided into subarrangements of 4 2×2 checkerboards;

c) determining the number of change keys assigned to each master key for levels $L_2$ through levels $L_n$;

d) starting with the group of unassigned change keys with the most levels of master keys above it, selecting a number of unassigned contiguous squares from the checkerboard representing at least the number of change keys in the selected group and placing pieces on the 8×8 checkerboard array, each piece covering the selected number of unassigned contiguous squares, wherein the number of squares=¼, 1, 4, or 16, a 4 square selection coinciding with one of the 2×2 checkerboards and a 16 square selection coinciding with one of the 4×4 checkerboards, all groups of assigned change keys below any master key $L_{n-1}$–$L_2$ being within the same 2×2 or 4×4 checkerboard;

e) repeating step d for all groups of change keys grouped below the first master key above the first selected group of change keys;

f) repeating steps d and e for all remaining unassigned change keys grouped below the highest master key in the tree for the selected group; and g) repeating steps d through f for all remaining change key groups, selecting any change key groups having only master key $L_n$ in its respective tree after all other groups are completed.

2. Method of master keying a system of locks, the locks using a p pin cylinder, each pin having b bittings, the method comprising:

a) providing a key system schematic, the key system schematic defining: 1) a plurality of levels of master keys, the lowest level master key being level $L_2$ and the highest level master key being $L_n$, 2) a plurality of change keys, the change keys being assigned to a master key and assigned to groups, 3) a plurality of trees consisting of a master key and any lower level master keys and change keys which are operated by the master key;

b) providing an array having $(b-1)^{(p-3)}$ elements wherein each element represents $(b-1)^3$ possible key bitting combinations, the array being divided into a plurality of subarrays, the first division being into subarrays of $(b-1)^{(p-4)}$ elements, the divided subarrays being repeatedly divided into further subarrays of $(b-1)^{(p-x)}$ elements, x=5, 6, . . . , p−1;

c) determining the number of change keys assigned to each master key for levels $L_2$ through levels $L_{n-1}$;

d) starting with a group of unassigned change keys, selecting a number of unassigned contiguous elements from the subarray representing at least the number of change keys in the selected group and placing pieces on the array, each piece covering the selected number of unassigned contiguous elements, all groups of assigned change keys below any master key $L_{n-1}$31 $L_2$ being within the same subarray;

e) repeating step d for all groups of change keys grouped below the first master key above the selected group of change keys;

f) repeating steps d and e for all remaining unassigned change keys grouped below the highest master key in the tree for the selected group; and g) repeating steps d through f for all remaining change key groups, selecting any change key groups having only master key $L_n$ in its respective tree after all other groups are completed.

3. The method of master keying according to claim 2, wherein p=6 and b=5.

4. The method of master keying according to claim 2, wherein step d starts with the first group of unassigned change keys with the most levels of master keys above it.

5. Method of master keying a system of locks, the locks using a p pin cylinder, each pin having b bittings, the method comprising:

a) providing a key system schematic, the key system schematic defining: 1) a plurality of levels of master keys, the lowest level master key being level $L_2$ and the highest level master key being $L_n$, 2) a plurality of change keys, the change keys being assigned to a master key and assigned to groups, 3) a plurality of trees consisting of a master key and any lower level master keys and change keys which are operated by the master key;

b) providing an array having $(b-1)^{(p-3)}$ elements wherein each element represents $(b-1)^3$ possible key bitting combinations, the array being divided into a plurality of subarrays, the first division being into subarrays of $(b-1)^{(p-4)}$ elements, the divided subarrays being repeatedly divided into further subarrays of $(b-1)^{(p-x)}$ elements, x=5, 6, . . . , p−1;

c) determining the number of change keys assigned to each master key for levels $L_1$ through levels $L_{n-1}$;

d) starting with a group of unassigned change keys, selecting a subarray having at least (b−1) times the number of change keys in the selected group of unassigned elements, and placing pieces on the array, each piece covering the selected number of unassigned elements, selecting an initial element of the selected subarray and every $1/b-1^{th}$ element of the selected subarray thereafter, all groups of assigned change keys below any master key $L_{n-1}$–$L_2$ being within the same subarray, each subarray containing only group assignments from a single tree;

e) repeating step d for all groups of change keys grouped below the first master key above the selected group of change keys;

f) repeating step d and e for all remaining unassigned change keys grouped below the highest master key in the tree for the selected group; and g) repeating steps d through f for all remaining change key groups, selecting any change key groups having only master key $L_n$ in its respective tree after all other groups are completed.

6. The method of master keying according to claim 5, wherein b=5 and p=6.

7. The method of master keying according to claim 5, wherein step d starts with the first group of unassigned change keys with the most levels of master keys above it.

8. A method of visually representing a system of locks, the locks using 6 pin cylinders, each pin having 5 bittings, the method comprising:

establishing a lock system hierarchy outlining multiple planned change key combinations operable under multiple levels of planned master keys;

providing an 8×8 checkerboard array of squares, wherein each square represents 64 possible change key bitting combinations, the entire 8×8 array representing 4096 possible change key combinations;

identifying four 4×4 sub-arrays of squares within the 8×8 array, each 4×4 subarray being located in a comer of the 8×8 array;

identifying four 2×2 sub-arrays of squares within each 4×4 sub-array, each 2×2 sub-array being located in a comer of the 4×4 sub-array, the entire 8×8 array of squares representing a possible master key which operates all 4096 possible change key combinations, each 4×4 sub-array of squares representing a possible master key which operates 1024 of the 4096 possible change key combinations, each 2×2 sub-array of squares representing a possible master key which operates 256 of the 4096 possible change key combinations, each individual square representing a possible master key which operates 64 of the 4096 possible change key combinations, and each one-fourth square representing a possible master key which operates 16 of the 4096 possible change key combinations, and placing square pieces on the 8×8 checkerboard array of squares, each piece representing a planned master key of the hierarchy and being sized to cover one of a one-fourth square, a square, a 2×2 sub-array, a 4×4 sub-array, or the 8×8 array representing a possible master key of the 8×8 array, each possible master key to which a planned master key is assigned representing a number of possible change key combinations greater than or equal to the number of planned change key combinations operable by the planned master key being assigned.

9. A method of visually representing a system of locks, the locks using X pin cylinders, each pin having Y bittings, the method comprising:

establishing a lock system hierarchy outlining multiple planned change key combinations operable under multiple levels of planned master keys;

providing an 8×8 checkerboard array of squares, wherein each square represents $(Y-1)^3$ possible change key bitting combinations, the entire 8×8 array representing $(Y-1)^X$ possible change key combinations;

identifying four 4×4 sub-arrays of squares within the 8×8 array, each 4×4 sub-array being located in a comer of the 8×8 array;

identifying four 2×2 sub-arrays of squares within each 4×4 sub-array, each 2×2 sub-array being located in a comer of the 4×4 sub-array, the entire 8×8 array of squares representing a possible master key which operates all $(Y-1)^X$ possible change key combinations and, each 4×4 sub-array of squares representing a possible master key which operates $(Y-1)^{X-1}$ of the $(Y-1)^X$ possible change key combinations, each 2×2 sub-array of squares representing a possible master key which operates $(Y-1)^{X-2}$ of the $(Y-1)^X$ possible change key combinations, each individual square representing a possible master key which operates $(Y-1)^{X-3}$ of the $(Y-1)^X$ possible change key combinations, and each one-fourth square representing a possible master key which operates $(Y-1)^{X-4}$ of the $(Y-1)^X$ possible change key combinations, and placing square pieces on the 8×8 checkerboard array of squares, each piece representing a planned master key of the hierarchy and being sized to cover one of a one-fourth square, a square, a 2×2 sub-array, a 4×4 sub-array, or the 8×8 array representing a possible master key of the 8×8 array, each possible master key to which a planned master key is assigned representing a number of possible change key combinations greater than or equal to the number of planned change key combinations operable by the planned master key being assigned.

10. A method of visually representing a system of locks, comprising:

establishing a lock system hierarchy outlining multiple planned change key combinations operable under multiple levels of planned master keys;

providing an array of shapes, the array of shapes being dividable into multiple levels of sub-arrays of shapes, each shape representing multiple possible change key combinations, each sub-array representing a possible master key combination operating the possible change key combinations of each shape within the sub-array; and placing pieces on the array of shapes, each piece representing a planned master key and being sized and shaped to cover a sub-array representing a number of possible change key combinations greater than or equal to the number of planned change key combinations to be operated by the planned master key according to the lock system hierarchy.

11. The method of claim 10, wherein the shapes are squares.

12. The method of claim 11, wherein the arrays are square arrays.

13. A method of master keying a system of locks, each lock using a six pin cylinder, each pin having five bittings, the method comprising:

establishing a key schematic defining a plurality of master keys, each master key operating a plurality of change keys assigned to the master key;

providing an 8×8 array of shapes, each shape representing 64 possible key bitting combinations; and placing pieces on the 8×8 array, each piece representing one of the master keys and covering a portion of the 8×8 array representing a number of possible key bitting combinations greater than or equal to the number of change keys assigned to the one of the master keys.

14. The method of claim 13 wherein the 8×8 array is dividable into four 4×4 subarrays and each 4×4 subarray is dividable into four 2×2 subarrays, and the pieces to be placed are substantially sized and shaped to cover one of the subarrays.

15. The method of claim 13, wherein the pieces to be placed are substantially sized and shaped to cover one of ¼, 1, 4, or 16 contiguous shapes of the 8×8 array.

* * * * *

UNITED STATES PATENT AND TRADEMARK OFFICE

CERTIFICATE OF CORRECTION

PATENT NO. : 6,516,644 B1 
DATED : February 11, 2003
INVENTOR(S) : Lloyd Seliber It is certified that error appears in the above-identified patent and that said Letters Patent is hereby corrected as shown below:

Column 8,
Line 25, delete "31", and insert -- - --.

Column 9,
Line 51, after "and", insert -- ¶ --.

Column 10,
Line 23, after "and", insert -- ¶ --.

Signed and Sealed this

Second Day of September, 2003

JAMES E. ROGAN
*Director of the United States Patent and Trademark Office*